US008917188B2

(12) United States Patent
Wietfeld et al.

(10) Patent No.: US 8,917,188 B2
(45) Date of Patent: Dec. 23, 2014

(54) METHOD FOR DETECTING AND WARNING AGAINST WRONG-WAY DRIVERS, AND WRONG-WAY DRIVER REPORTING AND WARNING SYSTEM

(75) Inventors: Christian Wietfeld, Dortmund (DE); Andreas Lewandowski, Dortmund (DE); Kai Okulla, Werdohl (DE)

(73) Assignees: Wilhelm Schroeder GmbH, Herscheid (DE); Technische Universitaet Dortmund, Dortmund (DE)

( * ) Notice: Subject to any disclaimer, the term of this patent is extended or adjusted under 35 U.S.C. 154(b) by 76 days.

(21) Appl. No.: 13/699,312

(22) PCT Filed: Jun. 28, 2011

(86) PCT No.: PCT/EP2011/003178

§ 371 (c)(1),
(2), (4) Date: Feb. 8, 2013

(87) PCT Pub. No.: WO2012/000651

PCT Pub. Date: Jan. 5, 2012

(65) Prior Publication Data

US 2013/0147639 A1 Jun. 13, 2013

(30) Foreign Application Priority Data

Jun. 28, 2010 (DE) ..... 10 2010 025 379

(51) Int. Cl.

| | |
|---|---|
| ***G08G 1/09*** | (2006.01) |
| ***G08G 1/056*** | (2006.01) |
| ***G08G 1/0967*** | (2006.01) |
| ***G08G 1/095*** | (2006.01) |
| ***G08G 1/16*** | (2006.01) |

(52) U.S. Cl.

CPC ..... *G08G 1/056* (2013.01); *G08G 1/096758* (2013.01); *G08G 1/096775* (2013.01); *G08G 1/096783* (2013.01); *G08G 1/095* (2013.01); *G08G 1/164* (2013.01)

USPC ..... 340/905; 340/693.9; 340/568.1

(58) Field of Classification Search

USPC ..... 340/905, 901, 935, 903, 902, 988, 907, 340/568.1, 568.8, 693.5, 693.9

See application file for complete search history.

(56) References Cited

U.S. PATENT DOCUMENTS 4,968,979 A 11/1990 Mizuno et al.
6,201,387 B1 * 3/2001 Govari ..... 324/207.17

(Continued)

FOREIGN PATENT DOCUMENTS

AT 4644 9/2001
DE 10126548 12/2002

(Continued)

OTHER PUBLICATIONS

Alhmiedat et al., "Tracking Multiple Mobile Targets Based on the ZigBee Standard," Proceedings of the 35th Annual Conference of the IEEE Industrial Electronics Society, 2009, pp. 2726-2731.

(Continued)

*Primary Examiner* — Daniel Previl

(74) *Attorney, Agent, or Firm* — Sheridan Ross P.C.

(57) ABSTRACT

The present invention relates to a method for detecting and warning against wrong-way drivers, the method comprising the following steps:

a) establishing a radio field over a roadway section to be monitored and at least substantially transversely to a predetermined correct driving direction of the roadway section, the radio field having at least two radio field sections that are spaced apart when viewed in the driving direction and have associated reception field strengths;

b) detecting attenuations of the reception field strengths of the radio field sections that occur due to radio shadowing during driving through the roadway section;

c) determining the sequence of the radio field sections in which an attenuation of the respectively associated reception field strengths has been detected;

d) comparing the determined attenuation sequence with the correct driving direction; and e) initiating at least one warning signal if the attenuation sequence runs opposite to the correct driving direction.

14 Claims, 5 Drawing Sheets

(56) References Cited

U.S. PATENT DOCUMENTS

| | | | | |
|---|---|---|---|---|
| 6,384,742 | B1 * | 5/2002 | Harrison | 340/944 |
| 8,265,987 | B2 * | 9/2012 | Goto | 705/13 |
| 2011/0081201 | A1 * | 4/2011 | Croce | 404/16 |
| 2011/0121992 | A1 * | 5/2011 | Konaka et al. | 340/905 |

FOREIGN PATENT DOCUMENTS

| | | |
|---|---|---|
| EP | 1 339 033 | 8/2003 |
| FR | 2 723 239 | 2/1996 |
| JP | 2000 348283 | 12/2000 |
| JP | 2007 139650 | 7/2007 |

OTHER PUBLICATIONS

International Search Report prepared by the European Intellectual Property Office for International Application No. PCT/EP2011/003178, dated Oct. 10, 2011.

Translation of the International Search Report prepared by the European Intellectual Property Office for International Application No. PCT/EP2011/003178, dated Oct. 10, 2011.

* cited by examiner

METHOD FOR DETECTING AND WARNING AGAINST WRONG-WAY DRIVERS, AND WRONG-WAY DRIVER REPORTING AND WARNING SYSTEM

CROSS REFERENCE TO RELATED APPLICATION

This application is a national stage application under 35 U.S.C. 371 of PCT Application No. PCT/EP2011/003178 having an international filing date of Jun. 28, 2011, which designated the United States, which PCT application claimed the benefit of German Patent Application No. 10 2010 025 379.0, filed on Jun. 28, 2010, both of which are incorporated by reference in their entirety.

FIELD OF THE INVENTION

The present invention relates to a method for detecting and warning against wrong-way drivers and to a wrong-way driver reporting and warning system.

BACKGROUND OF THE INVENTION

Every year, several thousand accidents that are caused by wrong-way drivers (also called "ghost drivers") occur in Germany alone—especially on highways. The consequences of a collision with a wrong-way driver are even nowadays mostly life-threatening if not fatal. Nevertheless, there are currently no active safety measures or direct warning systems for traffic participants who are directly within the danger area and affected thereby. It is true that traffic information within the transmission area is provided by the car radio via TMC (Traffic Message Channel). However, the latency of the traffic service is much too high on account of the manual alerting routes. Although the patent literature makes several suggestions, these have so far not been put into practice—above all for reasons of costs. For instance, DE 101 26 548 A1 discloses a driving-direction monitoring system in which transmitters are provided at the roadway side for emitting signals which are to be processed at least into warning signals by vehicle-mounted receivers or by a vehicle-mounted central data processing device communicating with said receivers. However, it would be very troublesome to put this concept into practice since all vehicles would have to be equipped with corresponding receiving and processing units. Moreover, in the case of intended wrong-way driving, wrong-way travels cannot be prevented by outputting a signal to the wrong-way driver. Therefore, in the case of wrong-way driving DE 101 26 548 A1 suggests manipulations with the on-board electronic system, the fuel supply and/or the ignition coil and/or the engine control and/or the brakes of the respective vehicle, which would raise the investment costs even more.

SUMMARY OF THE INVENTION

It is therefore the object of the present invention to provide a method for detecting and warning against wrong-way drivers as well as a wrong-way driver reporting and warning system according to the preamble of claim 10 which without any special technical and financial efforts can be used ubiquitously while ensuring a highly reliable alarm triggering accuracy at the same time.

This object is achieved with respect to the method according to the invention by the features of claim 1 and with respect to the system according to the invention by the features of claim 10.

According to the invention it is possible to monitor roadway sections to be monitored, e.g. relevant locations on highways or also at resting or parking places or also one-way streets, and to initiate warning signals if the monitoring operation reveals that in a direction opposite to the correct driving direction of the roadway section to be monitored a vehicle is entering said section.

The method according to the invention can be roughly subdivided into the following three phases that can be implemented by the components of the system according to the invention:

First Phase: Detection of Wrong-Way Travels

For instance, it is possible to fixedly install radio modules for detecting wrong-way travels on the guard rails of a roadway section to be monitored, e.g. a highway entrance/exit. These radio modules use the radio shadowing principle to detect driving in the wrong direction. Variations in the reception field strength, caused by the vehicle driving therethrough, are here detected. A central beacon can here fuse the radio field information from all installed beacons of the detection system and thereby detect the direction of the vehicle driving therethrough.

Second Phase: Local Alerting in Case of a Detected Wrong-Way Travel

After a wrong-way travel has been detected, alerting strategies are taken for the traffic participants concerned and preferably also for the wrong-way driver within the direct danger area. On the one hand it is possible to equip the alerting beacons with optical warning units. These alerting beacons can be distributed over a large roadway section and are wirelessly connected to the detection system, preferably via a so-called "hop-to-hop network". Such a "hop-to-hop network" means the delivery of information from one beacon to the other, so that even great distances from the monitored roadway section can be bridged with low transmitting powers. In a further configuration stage alerts can also be sent via the established short-distance radio network to local warning units in vehicles; as regards the efficiency of the method according to the invention and of the system according to the invention and the prevention of investments that are at least high at the beginning, this is however not imperative for operational reliability.

Third Phase: Long Range Traffic Warning Via Mobile Radio and Radio

Furthermore, a detected wrong-way travel of low latency can be sent in an automated way to a traffic control center by optionally connecting the detection system to the mobile radio network. Warnings can be sent from that center to the traffic participants concerned.

The sub-claims refer to advantageous developments of the method according to the invention and of the wrong-way driver reporting and warning system according to the invention.

For instance, the radio modules may comprise an integrated housing solution with so-called "energy harvesting possibilities", which permits a low-maintenance operation without permanent power supply.

Furthermore, an integrated detection and communication is feasible at low costs with minimal energy and installation efforts.

Detection can be independent of the vehicle equipment and the ambient characteristics, i.e., a reliable detection of intended wrong-way travels is also possible, especially since a clearly described or defined detection area is obtained according to the invention.

As has been explained above, both local warnings and wide-area traffic warnings can be issued.

Furthermore, the inventive procedure regarding the evaluation of the shadowings permits an integrated system without any additional sensor unit. Moreover, the basic principle "attenuation/interruption" according to the invention yields the advantage of low transmission powers.

Finally, the advantage is achieved that the vehicles themselves are not identified by the method according to the invention so that no data protection problems will arise upon use of the method according to the invention and of the system according to the invention.

The method according to the invention and the system according to the invention are based on a cost-optimized radio solution in the sense of energy consumption. To this end it is possible to employ the IEEE 802.15.4 standard for short range communication because by comparison with e.g. WLAN standards this standard works with a much lower transmitting power and uses a medium access control (MAC) layer that is optimized for battery operation. IEEE 802.15.4 operates in this case with a maximum transmission power of 0 dBm, whereas WLAN uses transmission powers that are ten times higher. Nevertheless, the resulting ranges do not significantly differ from one another. For instance, the IEEE 802.15.4 is achieved in the free field at a high throughput at a distance of up to 100 m. Another advantage is the small constructional size of the already available modules. The local radio module can here be used for the detection of wrong-way drivers, for internal communication between the marks via a mesh network and also for optional communication between the beacons and a mobile warning unit at the side of the wrong-way driver.

The detection system is preferably able to carry out an independent detection of wrong-way drivers. It is here intended to detect passive objects (i.e., no active participants in the radio network) on the basis of the impacts on the radio field. Preferably, for this purpose beacons are periodically emitting pilot signals for establishing the radio network. A network of redundant connections can thereby be established.

The number of the radio modules to be used can here be adapted to the respective place to the monitored, where preferably a plurality of bidirectional connections are continuously monitored at a defined time interval. When a vehicle moves through one of the connections, shadowing will occur. This shadowing causes an attenuation of the RSSI (Received Signals Strength Indicator), i.e., the resulting reception field strength. This decline can be reliably detected when the pilot signals are emitted within a reasonably defined interval, so that a compromise can be found between power consumption and detection speed. It is thereby possible that the system detects the sequence of the connections with signal strength field variations and thereby discovers whether the vehicle is traveling in the correct direction.

For optimizing an operation cycle it is furthermore possible to create a logic software. On the one hand this logic ensures the correct interpretation of the wrong-way driver detection. On the other hand, the information about the detection can be passed on to a master module (master beacon) which is able to fuse the information from all beacons to obtain an overall view. Moreover, the logic is used for adapting the operational states.

The preferably provided wide-area traffic communication represents a forwarding of the detected wrong-way travel to the entire traffic network, but according to the invention it constitutes a further technological aspect that is not imperative according to the method according to the invention and the system according to the invention. It is however in principle possible to represent such a long range traffic communication with the principles according to the invention, where e.g. an integrated UMTS module on the master beacon can deliver the warning to a traffic control center that will send a warning to the other traffic participants via TMC. It is furthermore possible according to the invention to additionally send a fast warning via a UMTS cell broadcast to the nearby traffic participants. This cell broadcast is then receivable by the mobile wrong-way driver warning units in the vehicles and is propagated much faster than a manual TMC alert.

Further details, advantages and features of the present invention become apparent from the following description of embodiments with reference to the drawing, in which:

LIST OF REFERENCE NUMERALS

Figure 1:
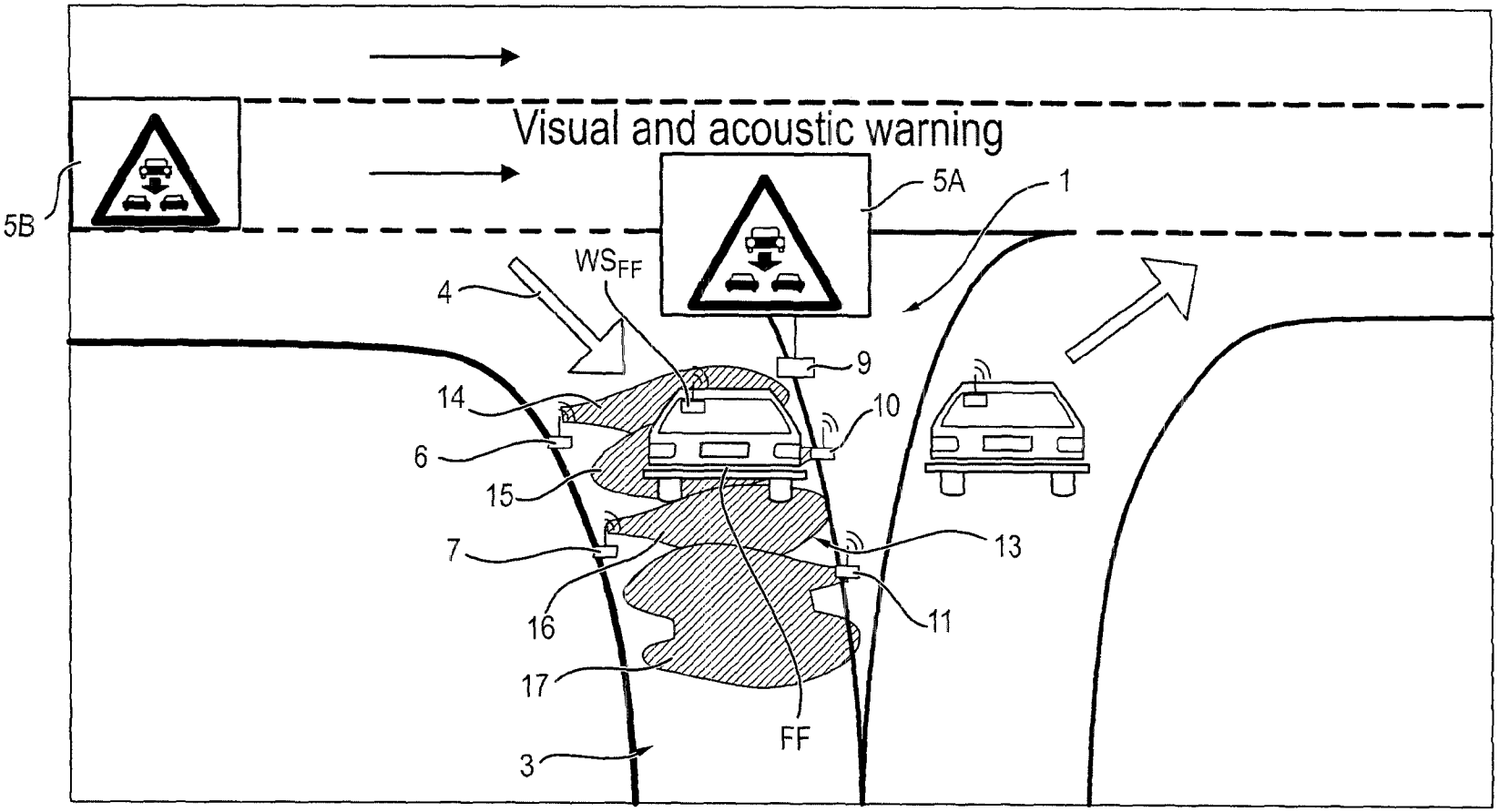
FIGS. 1, 2A, 2B show considerably simplified schematic diagrams for explaining the basic components and modes of operation of the method according to the invention and of the system according to the invention.

1 wrong-way driver reporting and warning system
2 detection device
3 roadway section
4 correct driving direction
5 warning device
5A local warning device
5B more distant warning device
6, 7 radio transmitter
8 roadway side
9, 10, 11 radio receiver
12 opposite roadway side
13 radio field
14, 15, 16, 17 spaced-apart radio field sections
18 evaluation device
19 warning center
20 mobile warning unit
21 guard rail
22 cat's eye
23 reflector
24, 25, 26 plug type devices
27, 28 plug type receptacles
RF transmitting unit
OS optional sensor system
DT detection device/receiver
E energy source
WS, WS", WS"', WS"" warning signals
$WS_{FF}$ warning signal to the wrong-way driver FF
AS radio shadowing
EFS reception field strength

DETAILED DESCRIPTION

Figures 2A, 2B:
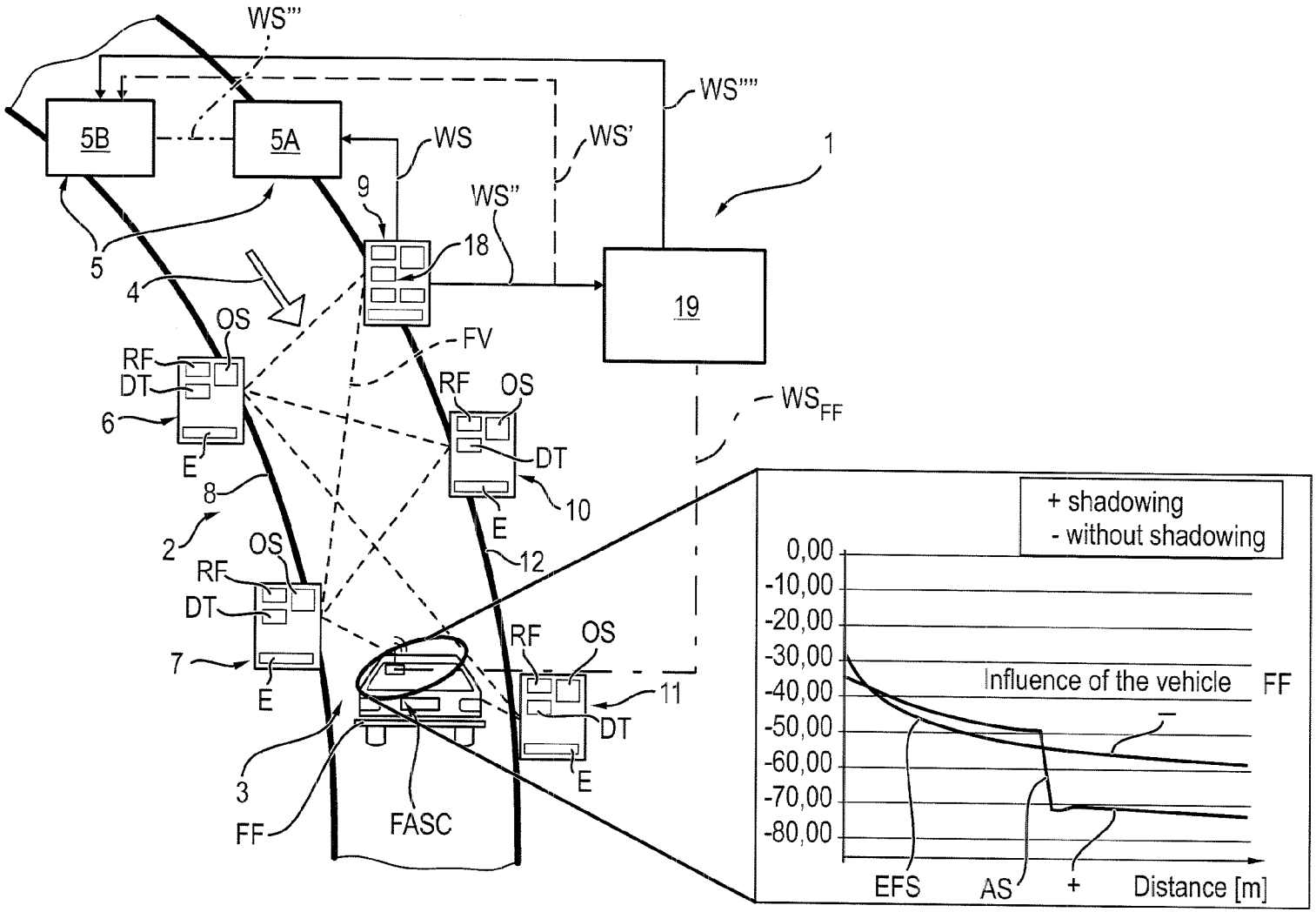

FIGS. 1 and 2A show considerably simplified schematic diagrams illustrating a possibility of forming a wrong-way driver reporting and warning system 1 according to the invention, where the illustration of FIG. 1 may represent a highway entrance/exit.

The roadway section 3 to be monitored in this instance is provided with a detection device 2 for the purpose of monitoring said section. The roadway section 3 comprises an associated correct driving direction 4; i.e., in the illustrated example it represents the highway exit. For the purpose of explaining the functional principles according to the invention a wrong-way driver FF is entering this exit with his/her vehicle in a direction opposite to the correct driving direction 4.

Furthermore, the system 1 according to the invention comprises a warning device 6 which, as shall be described in more detail hereinafter, is provided for outputting at least one warning signal in response to the measurement result of the detection device 2, the signals being identified in the drawing by reference numerals WS, WS', WS" and WS'".

The detection device 2 comprises a plurality of radio transmitters, in the illustrative example two radio transmitters 6 and 7, at a roadway side 8 of the roadway section 3 to be monitored. When viewed in the driving direction 4, the radio transmitters 6 and 7 are here arranged in spaced-part relationship with each other along the roadway side 8. Of course, it is also possible to provide a greater number of radio transmitters along the roadway side 8.

At the opposite roadway side 12 of the roadway section 3 to be monitored, there are provided a plurality of radio receivers, in the illustrative example three radio receivers 9, 10 and 11, which, viewed in the driving direction 4, are also spaced apart from one another and are provided for establishing a radio field 13 with at least two radio field sections 14, 15, 16 and 17, which are spaced apart when viewed in the driving direction 4, by receiving the radio signals emitted by the radio transmitters 6, 7. It is also true in this case that a greater number of radio receivers may be provided along the driving direction 4 at the opposite roadway side 12.

Figure 3:
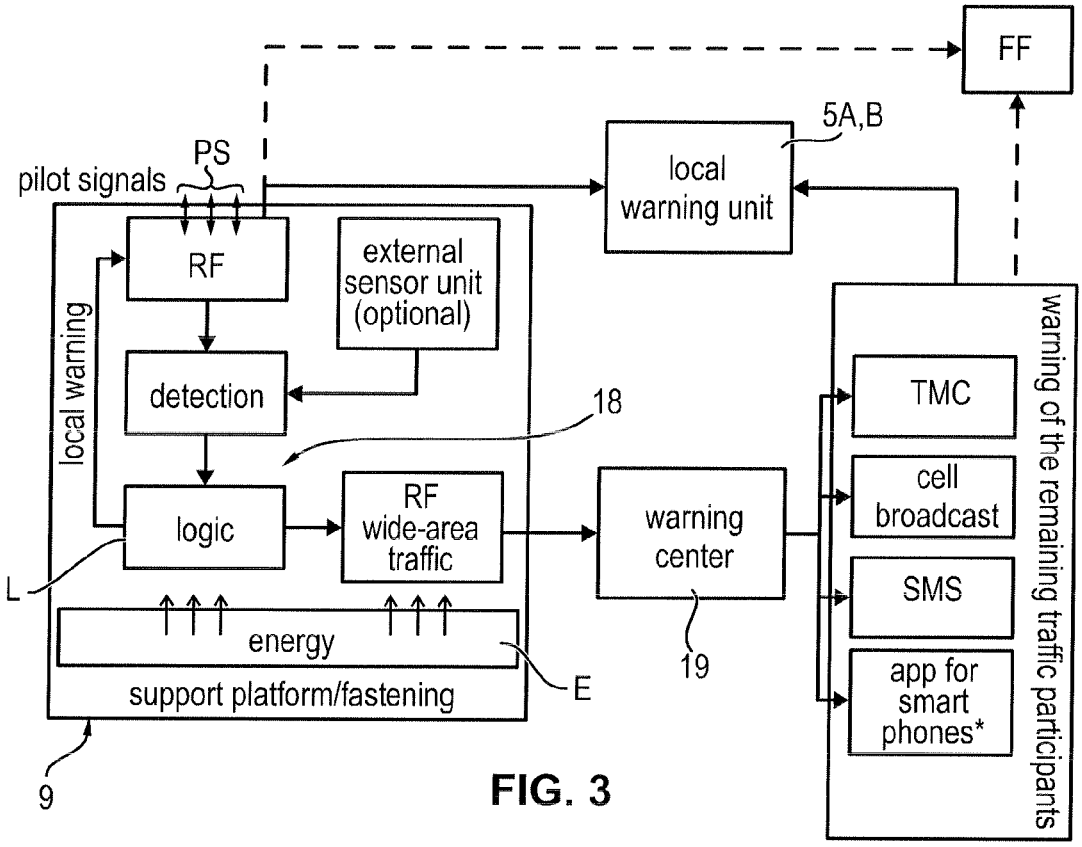
FIG. 3 shows a considerably simplified block diagram of a master beacon with further components of the system of the invention that are in operative communication therewith.

Finally, the system 1 according to the invention comprises an evaluation device 18 (see FIG. 3).

The radio transmitters 6 and 7 and the radio receivers 10 and 11 are each configured as identical radio modules. Each comprises a transmitting unit RF which emits pilot signals PF, a receiving (detection) unit DT, an optional sensor unit OS as well as an energy supply unit E.

The radio module 9 which forms a master module (master beacon) further comprises a logic unit L as well as a further transmitting unit RF for long-range transmission. This becomes apparent from the illustration of FIG. 3. The radio modules 6, 7, 10 and 11 can operate as both transmitter and receiver and can thus also be arranged alternatingly at the roadway sides 8 and 12, respectively, depending on what is required by the respective application and what makes sense.

The master module 9 serves to fuse all information and to inform the warning device 5, an external warning center 19 and, in the event that vehicles are provided with corresponding receiving units, wrong-way driver vehicles as well as vehicles of other participants about detected risks or to warn against such risks.

As becomes apparent from FIG. 3, the warning center 19 may be provided for this purpose with TMC, cell-broadcast, SMS or application modules for smart phones via which, as has been said, local warning units 5A, 5B, wrong-way drivers FF or also other traffic participants can be warned after detection of a wrong-way driver FF.

A has already been stated repeatedly, the equipment of vehicles with mobile warning units is an option that is not imperative for the function of the method according to the invention or the system according to the invention.

Figure 4:
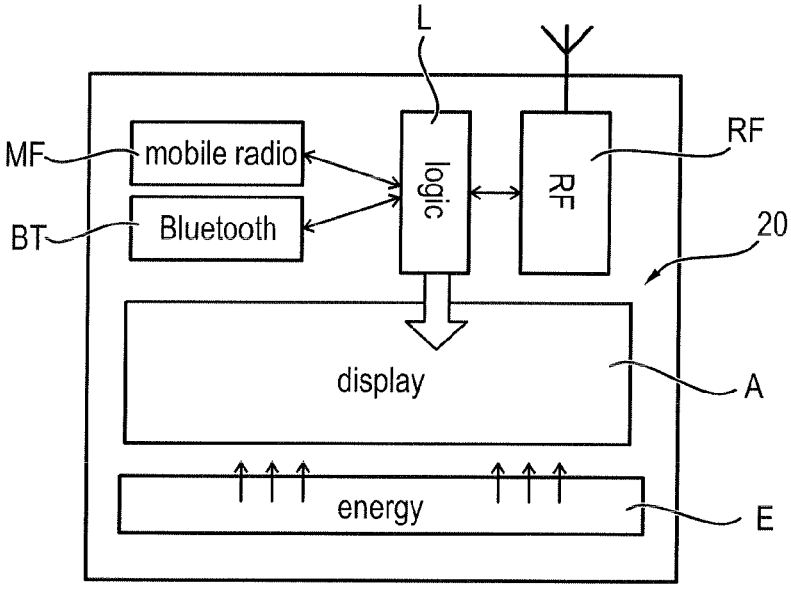
FIG. 4 shows an illustration conforming to FIG. 3 for explaining the construction principle of a mobile warning unit to be provided in an optional way.

FIG. 4 shows a schematically considerably simplified illustration of such a mobile warning unit 20 that may comprise an energy supply E, a display unit A, a transmitting/receiving unit RF, a logic module L, as well as a mobile radio module MF and a Bluetooth module BT. Hence, the mobile warning unit 20 is based on an equivalent platform as compared with the transmitting and receiving units of the detection device 2.

Figure 5:
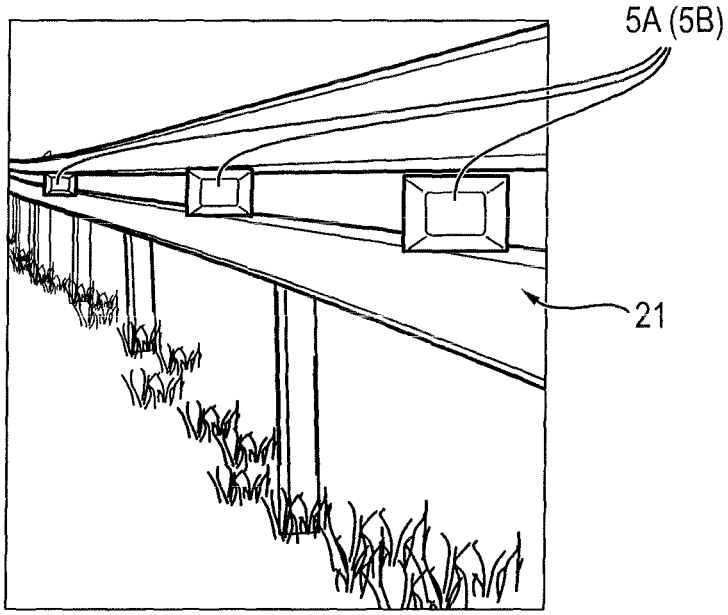
FIG. 5-8 show schematic diagrams for mounting radio modules on installations of roadway sections to be monitored, such as e.g. guard rails and/or cats' eyes.

FIGS. 5 to 8 illustrate possible arrangements for warning devices and/or radio modules. FIG. 5 shows a guard rail 21 in which in the illustrative example three warning units 5A or 5B are arranged in spaced-apart relationship with one another.

Figure 6:
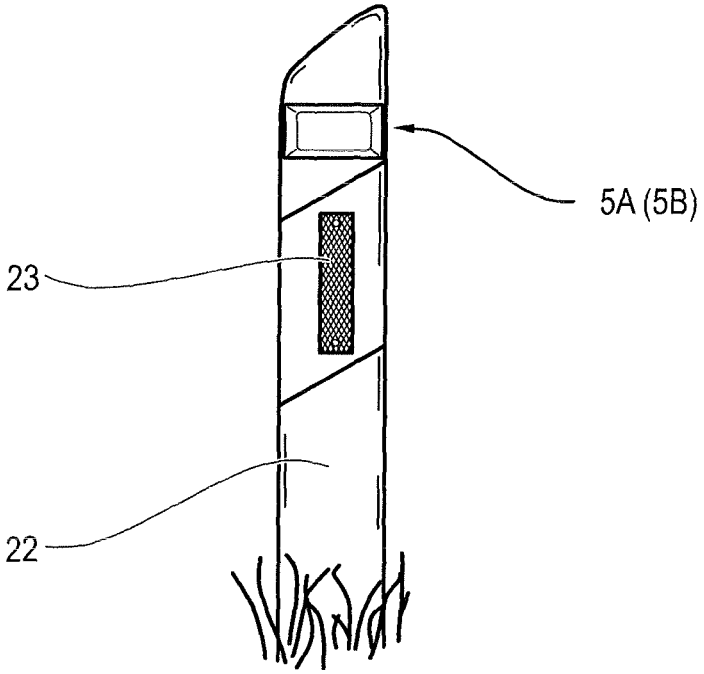
Figure 7:
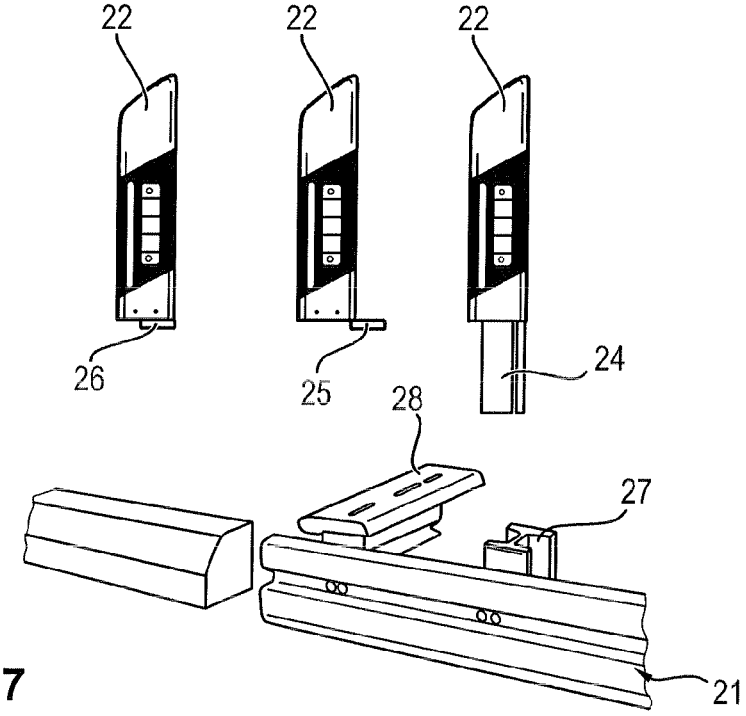
Figure 8:
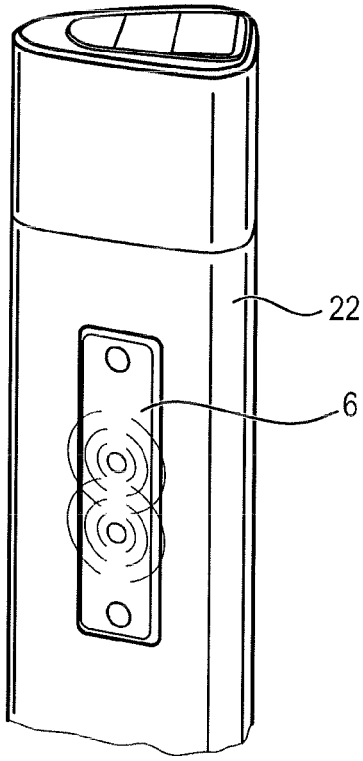

FIG. 6 shows a so-called cat's eye 22 which is provided with a warning unit 5A or 5B above the reflector 23.

FIG. 7 once again shows cats' eyes 22 which are provided with different plug-type fastening devices 24, 25 and 26, respectively, that can be inserted into corresponding plug-type receptacles 27 and 28, respectively, of a guard rail 21.

FIG. 8 once again shows the upper part of a cat's eye 22 which in this instance is provided with a radio module that is identified by reference numeral 6 in a representative way for all of the previously described radio modules.

The function of the method according to the invention for detecting and warning against wrong-way drivers FF shall once again be explained hereinafter with reference to FIGS. 1, 2A, 2B and 3.

First of all, a radio field 13 is established via the described transmitting modules 6, 7 and receiving modules 9, 10 and 11 over the roadway section 3 to be monitored. As follows from the synopsis of FIGS. 1 and 2A, at least two, in the illustrative example four, radio field sections 14, 15, 16 and 17 are formed that, viewed in the driving direction 4, are spaced apart from one another and have associated reception field strengths EFS. This radio field 13 is established by emitting and receiving pilot signals PS (see FIG. 3) from the said modules 6, 7, 9, 10 and 11 and extends substantially in a direction transverse to the predetermined correct driving direction 4 of the roadway section 3.

When a wrong-way driver FF is driving into the roadway section 3 to be monitored, which according to the illustration chosen in FIG. 1 is the left roadway section of a highway entrance or exit, the vehicle of the wrong-way driver FF is sensed by radio shadowing FASC (see FIG. 2A), resulting in attenuations AS of the reception field strengths EFF of the radio field sections 14 to 17 (see FIG. 2B).

The sequence of the radio field sections in which an attenuation AS of the respectively associated reception field strength EFS has been detected is here determined. In the illustrated example the sequence of the radio field sections is that of the associated reference numerals 17, 16, 15, 14, which in the subsequent comparative method step results in an attenuation sequence opposite to the correct driving direction 4.

In this case warning signals are initiated that are marked in FIG. 2A with reference numerals WS, WS', WS" and WS'". The warning signal WS is a signal to a local warning unit 5A, i.e., one close to the roadway section 3. The warning signal WS' is a signal to a more distant warning unit 5B. The warning signal WS" is a signal to the warning center 19 illustrated in FIGS. 2A and 3. The warning signal WS'" is a signal transmitted from the nearby warning unit 5A to the more distant warning unit 5B according to the hop-to-hop principle.

The warning units 5A and 5B output visual and/or acoustic warnings to the traffic participants next to the wrong-way driver FF in the traffic.

As has been explained above, the warning center 19, but in principle also the radio module 9 as the master module or master beacon, can output warning signals $WS_{FF}$ to the wrong-way driver FF. As follows from FIG. 2A, the warning center 19 can also actuate the more distant warning units 5B by way of the warning signal WS''''.

As follows from FIG. 3, the warning center 19 can of course in principle also actuate the locally nearby warning units 5A.

Apart from the above written disclosure of the invention, reference is herewith explicitly made to the graphic representation thereof in FIGS. 1, 2A, 2B and 3-8.

The invention claimed is:

1. A method for detecting and warning against wrong-way drivers, comprising:

establishing a radio field over a roadway section to be monitored and at least substantially transversely to a predetermined correct driving direction of the roadway section, the radio field having at least two radio field sections that are spaced apart when viewed in the driving direction and have associated reception field strengths;

detecting attenuations of the reception field strengths of the at least two radio field sections that occur due to radio shadowing during driving through the roadway section;

determining an attenuation sequence of the at least two radio field sections in which an attenuation of the respectively associated reception field strengths has been detected;

comparing the attenuation sequence with the correct predetermined driving direction; and initiating at least one warning signal if the attenuation sequence runs opposite to the correct predetermined driving direction.

2. The method according to claim 1, wherein the determination of the attenuation sequence comprises emitting periodic pilot signals that establishes the radio field or the radio field sections thereof.

3. The method according to claim 2, wherein the pilot signals are periodically emitted at defined intervals.

4. The method according to claim 1, wherein the radio field is established on the basis of the IEEE 802.15.4 standard in the 2.4 GHz or 800 MHz band.

5. The method according to claim 1, wherein the warning signal is emitted to all traffic participants in the direct vicinity of the roadway section to be monitored.

6. The method according to claim 1, wherein the warning signal is also emitted to more distant traffic participants.

7. The method according to claim 1, wherein at least one warning signal is additionally emitted to the wrong-way driver.

8. The method according to claim 1, wherein the warning signal output is carried out in an optical or acoustic manner.

9. The method according to claim 1, wherein the traffic-participant warning signal is also output to a traffic control center.

10. A wrong-way driver reporting and warning system comprising:

a detection device for monitoring a roadway section with associated correct driving direction; and a warning device which can be actuated in response to a measurement result of the detection device for outputting at least one warning signal, wherein the detection device comprises the following components:

a plurality of radio transmitters which are arranged at a roadway side of the roadway section to be monitored in spaced-apart relationship with one another when viewed in the driving direction;

a plurality of radio receivers which are arranged at an opposite roadway side of the roadway section to be monitored in spaced-apart relationship with one another when viewed in the driving direction, the plurality of radio receives being provided for establishing a radio field with at least two radio field sections by receiving the radio signals emitted by the plurality of radio transmitters, wherein the at least two radio field sections are spaced apart when viewed in the driving direction; and an evaluation device for determining a sequence of the occurrence of reception field strength attenuations of the radio field sections of the radio field.

11. The wrong-way driver reporting and warning system according to claim 10, wherein the radio transmitters and the radio receivers are configured as radio modules, each comprising transmitting and receiving units.

12. The wrong-way driver reporting and warning system according to claim 11, wherein the radio modules are provided with an independent energy supply.

13. The wrong-way driver reporting and warning system according to claim 10, further comprising a mobile warning unit which is installable in vehicles, and which communicates with the detection device.

14. The wrong-way driver reporting and warning system according to claim 10, wherein the warning device comprises warning units which are installable in guard rails or cats' eyes.

* * * * *